US007610635B2

(12) United States Patent
Schultz et al.

(10) Patent No.: US 7,610,635 B2
(45) Date of Patent: Nov. 3, 2009

(54) DRAIN CLEANER

(75) Inventors: Marissa A. K. Schultz, Racine, WI (US); Emily Schoenfelder, Buffalo, NY (US); David H. Roland, Middleton, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 237 days.

(21) Appl. No.: 11/746,205

(22) Filed: May 9, 2007

(65) Prior Publication Data

US 2008/0276392 A1 Nov. 13, 2008

(51) Int. Cl.
*E03C 1/23* (2006.01)
*A47K 1/14* (2006.01)

(52) U.S. Cl. ..... 4/689; 4/294; 4/295

(58) Field of Classification Search ..... 4/689, 4/294, 295, 692
See application file for complete search history.

(56) References Cited

U.S. PATENT DOCUMENTS

| | | | |
|---|---|---|---|
| 263,841 | A | 9/1882 | Birkett |
| 271,357 | A | 1/1883 | Pike |
| 300,636 | A | 6/1884 | Pike |
| 302,269 | A | 7/1884 | Lyons |
| 810,973 | A | 1/1906 | Pattenden |
| 852,044 | A | 4/1907 | Van Der Minden |
| 2,087,592 | A | 7/1937 | Chesnut |
| 2,283,780 | A | 5/1942 | Ahern |
| 2,311,196 | A | 2/1943 | Ahern |
| 2,315,673 | A | 4/1943 | Taylor |
| 2,723,905 | A | 11/1955 | Coakley |
| 2,968,441 | A | 1/1961 | Holcomb |
| 3,112,499 | A | 12/1963 | Thornton |
| 3,402,741 | A | 9/1968 | Yurdin |
| 3,937,404 | A | 2/1976 | Johnson |
| 4,103,367 | A | 8/1978 | Kaufer |
| 4,224,701 | A | 9/1980 | Huang |
| 4,321,712 | A | 3/1982 | Dixon |
| 4,574,403 | A | 3/1986 | Dintemann |
| 4,928,859 | A | 5/1990 | Krahn et al. |

(Continued)

FOREIGN PATENT DOCUMENTS

| | | |
|---|---|---|
| EP | 0180 451 A2 | 5/1986 |

(Continued)

OTHER PUBLICATIONS

PCT/US2008/005966 International Search Report and Written Opinion dated Jul. 24, 2008.

*Primary Examiner*—Huyen Le
*Assistant Examiner*—Karen Younkins

(57) ABSTRACT

A drain cleaner is disclosed for use with a drain assembly having a drain pipe, a flange coupled to the drain pipe and defining a drain inlet, and a pop-up assembly having an actuating arm disposed in the drain pipe. The drain cleaner includes a stopper head having a seal sized to engage the drain inlet and an inlet passage extending from an inlet port formed in a top surface of the stopper head to an outlet port formed in a bottom surface of the stopper head. A stopper guide has a proximal end coupled to the stopper head bottom surface and a distal end, the stopper guide distal end including a tail piece adapted to operatively engage the actuating arm of the pop-up assembly. A drain cleaning composition is supported below the stopper head bottom surface.

19 Claims, 4 Drawing Sheets

U.S. PATENT DOCUMENTS

| | | | | |
|---|---|---|---|---|
| 4,969,491 | A | 11/1990 | Kiplinger | |
| 5,019,346 | A | 5/1991 | Richter et al. | |
| 5,071,035 | A | 12/1991 | Kiplinger | |
| 5,312,624 | A | 5/1994 | Richter et al. | |
| 5,803,101 | A | 9/1998 | Gallo | |
| 5,940,894 | A | 8/1999 | Cruz | |
| 6,067,669 | A | 5/2000 | Peterson et al. | |
| 6,195,819 | B1 | 3/2001 | Wang | |
| 6,197,321 | B1 | 3/2001 | Richter et al. | |
| 6,253,971 | B1 | 7/2001 | Cobb | |
| 6,341,391 | B1 * | 1/2002 | Cheng | 4/689 |
| 6,558,538 | B2 | 5/2003 | Scuilla et al. | |
| 6,676,842 | B2 | 1/2004 | Scuilla et al. | |
| 6,866,440 | B1 * | 3/2005 | Bart | 4/295 |
| 6,915,814 | B2 | 7/2005 | Cheng | |
| 7,098,174 | B2 | 8/2006 | Takemura et al. | |
| 2004/0255378 | A1 * | 12/2004 | Tracy | 4/689 |

FOREIGN PATENT DOCUMENTS

| | | |
|---|---|---|
| EP | 1580337 | 9/2005 |
| JP | 2005-296910 | 10/2005 |
| NL | 287984 | 3/1965 |

* cited by examiner

DRAIN CLEANER

FIELD OF THE DISCLOSURE

The present disclosure generally relates to plumbing maintenance, and more particularly to apparatus and chemical compositions for removing clogs from drain pipes.

BACKGROUND OF THE DISCLOSURE

Various types of apparatus and chemical compositions are known for removing clogs formed in drain pipes. In some of these, a mechanical apparatus is provided for engaging and removing the clog-forming material from the drain pipe. In one example, the device includes an elongate, flexible, strip sized for insertion into the drain pipe. The strip has a length sufficient so that a distal end will contact the clog. The user may then apply pushing, pulling, twisting, or other force to the strip in an attempt to engage and/or dislodge all or part of the clog. The strip may include barbs or other projections extending from an exterior surface to improve the ability to snag or otherwise engage fibrous material that may be stuck in the drain pipe. Once the clog material is engaged, the device is withdrawn from the drain pipe, bringing the clog-forming material with it.

Other types of devices attempt to dislodge the clog by providing a fluid jet that is directed toward the clog. These devices may be connected to a source of pressurized fluid such as water or air, and may include an elongate member having a channel extending therethrough to direct pressurized fluid toward the location of the clog.

Alternatively, various chemical compositions are known which are adapted to disintegrate or dissolve clogs formed in drain pipes. The chemical compositions are typically provided in containers, and the user simply pours the chemical composition from the container into an inlet of the drain. More complex arrangements include a rubber mat for placement over the plumbing fixture adjacent the drain inlet to protect the plumbing fixture from the corrosive properties of the chemical composition. Other known apparatus provides a tube that is inserted partially into the drain pipe for accurately directing the chemical composition toward the clogged location.

Conventional drain cleaning apparatus are overly difficult to use when the drain pipe includes a plug. Bathroom sinks, for example, often include a pop-up stopper that may be actuated between open and closed positions. These stoppers typically include a tail piece that is coupled to an actuating arm of a pop-up assembly. The plugs often must be fully or partially removed prior to inserting mechanical apparatus or chemical compositions into the drain pipe, and subsequently are reinserted into the drain pipe. Unfortunately, such removal and reattachment can be difficult and time consuming.

In addition, known chemical drain cleaners are typically used only after a clog is detected, and therefore do not help prevent clogs from forming. Still further, chemical cleaners are typically introduced into the drain pipe near an inlet, and therefore are less effective for removing clogs formed at a point located more distally, such as in or after a U-joint formed in the drain pipe.

SUMMARY OF THE DISCLOSURE

According to certain aspects of the present disclosure, a drain cleaner is provided for use with a drain assembly that includes a drain pipe, a U-joint, and a flange coupled to the drain pipe and defining a drain inlet. The drain cleaner includes a stopper head having a seal sized to engage the drain inlet and an inlet passage extending from an inlet port formed in a top surface of the stopper head to an outlet port formed in a bottom surface of the stopper head. A cap is removably coupled to the inlet port, and a conduit is coupled to the stopper head with a proximal end in fluid communication with the stopper inlet passage and a distal end. A drain cleaning composition is supported below the stopper head bottom surface.

According to additional aspects of the disclosure, the drain cleaner may include a stopper head having a seal sized to engage the drain inlet and an inlet passage extending from an inlet port formed in a top surface of the stopper head to an outlet port formed in a bottom surface of the stopper head, a cap removably coupled to the inlet port, and a conduit coupled to the stopper head bottom surface with a proximal end in fluid communication with the stopper inlet passage and a distal end, wherein the conduit has a length sufficient so that the conduit distal end is positioned distally of the U-joint. A drain cleaning composition is supported below the stopper head bottom surface and around an exterior surface of the conduit.

According to further aspects of the disclosure, the drain assembly may include a pop-up assembly having an actuating arm disposed in the drain pipe. The drain cleaner may comprise a stopper head having a seal sized to engage the drain inlet and an inlet passage extending from an inlet port formed in a top surface of the stopper head to an outlet port formed in a bottom surface of the stopper head, a stopper guide having a proximal end coupled to the stopper head bottom surface and a distal end, the stopper guide distal end including a tail piece adapted to operatively engage the actuating arm of the pop-up assembly, and a drain cleaning composition supported below the stopper head bottom surface.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

Drain cleaners are disclosed herein for removing clog-forming material from drain pipes. In certain embodiments, the drain cleaner includes a stopper structure that is used in place of an existing drain stopper, the drain cleaner including a chemical composition depending therefrom. The drain cleaner further includes a tube communicating with a port formed in the stopper, the tube extending distally from the stopper structure. Normal use of the plumbing fixture will cause liquid to pass over and/or through the chemical composition, thereby to provide a preventative release of the drain cleaning composition into the drain pipe to prevent clogging. The preventative release is "passive" or "automatic" in that it occurs during normal use of the plumbing fixture, rather than requiring a user to take deliberate action to implement the chemical composition. The frequency of the preventative release is based primarily on the frequency of use of the plumbing fixture, and therefore in certain applications may be substantially continuous. If a clog should form downstream, additional drain cleaning chemical may be introduced through the stopper port which is then discharged from the distal end of the tube. This allows for more precise deployment of drain cleaner within the drain pipe. In other embodiments, the tube encloses the chemical composition so that the passive discharge of drain cleaner exits from the distal end of the tube, which may be positioned adjacent a portion of the drain pipe that is more susceptible to clogs such as in, or downstream of, the U-joint.

Figure 1:
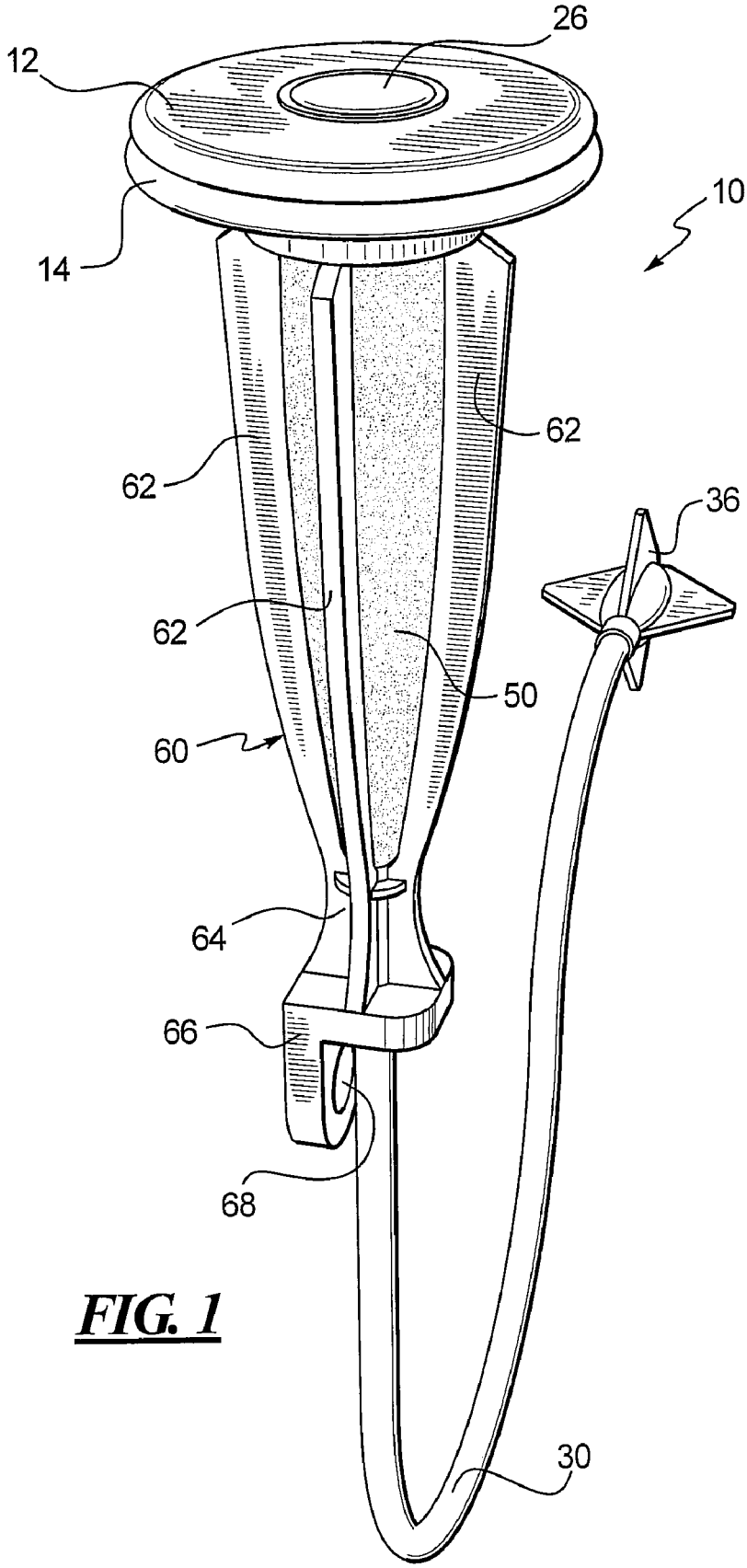
FIG. 1 is perspective view of a drain cleaner constructed according to the present disclosure.
Figure 2:
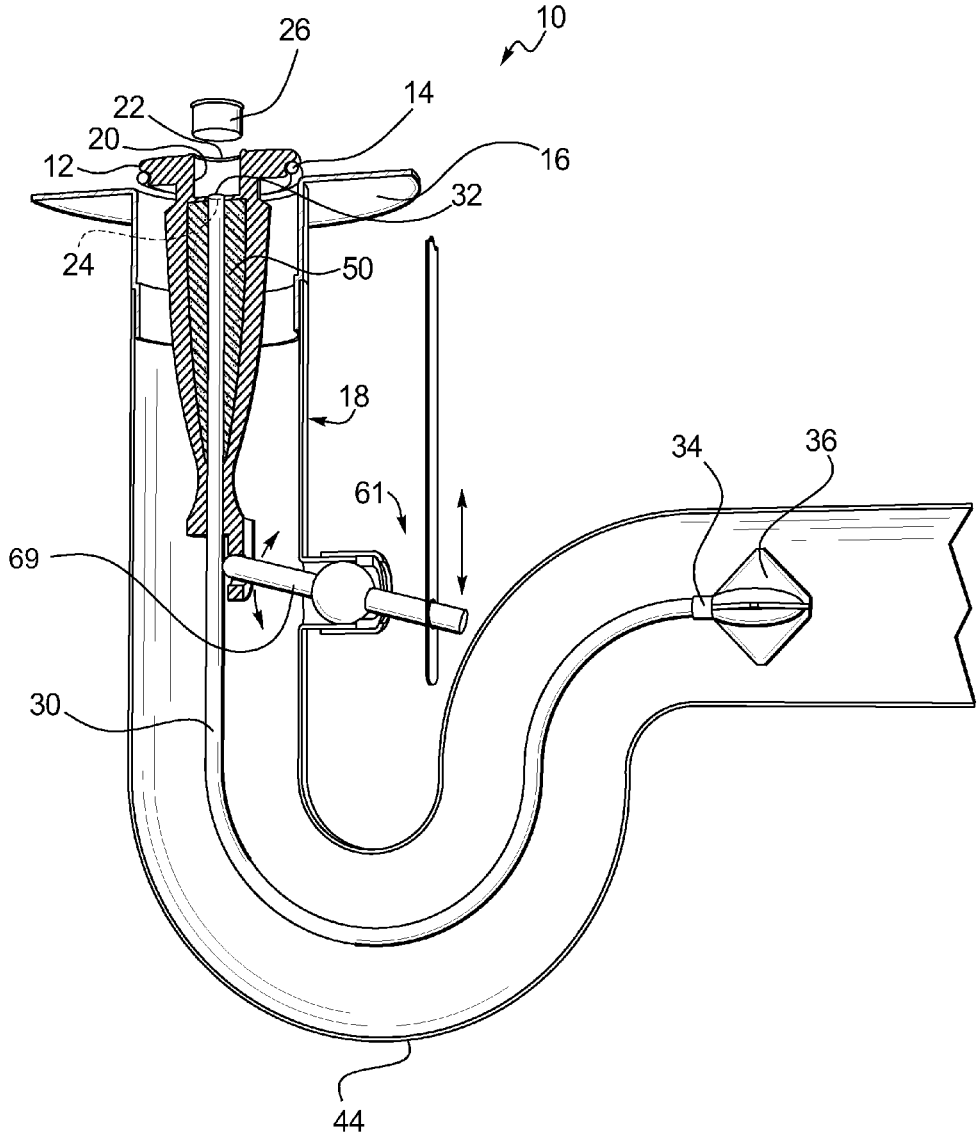
FIG. 2 is a side elevation view, in cross-section, of the drain cleaner of FIG. 1.

Referring to FIG. 1, a drain cleaner 10 is shown having a stopper head 12. A seal 14 is coupled to the stopper head 12 and sized to engage an inlet flange 16 of a drain pipe 18 (FIG. 2). An inlet passage 20 extends through the stopper head from an inlet port 22 formed in a top surface to an outlet port 24 formed in a bottom surface of the stopper head 12. A cap 26 is provided for selectively closing or opening the inlet passage 20. While the cap 26 is illustrated in FIGS. 1 and 2 as a separately removable member, it may alternatively be provided as an integral member or may be connected to the stopper head 12 by a link, chain, or other coupling device. The cap 26 may frictionally engage the inlet port 22 or may include threads or other releasable structure to retain the cap 26 in the closed position.

A conduit, such as tube 30, is provided for directing drain cleaning material toward a distal point in the drain pipe 18, as best shown in FIG. 2. The tube 30 includes a proximal end 32 coupled to the stopper head 12 and a distal end 34. The proximal end 32 fluidly communicates with the inlet passage 20. An anchor 36 may be coupled to the tube distal end 34 to help guide the tube 30 through the drain pipe 18 during installation of the drain cleaner 10. The tube 30 is preferably formed of a material that is sufficiently flexible to navigate potentially tortuous drain pipe paths while also resisting chemical reaction to most known drain cleaning compositions. Exemplary conduit materials include, but are not limited to, plastics such as polyvinylchloride (PVC) and polyethylene (PET).

Figure 3:
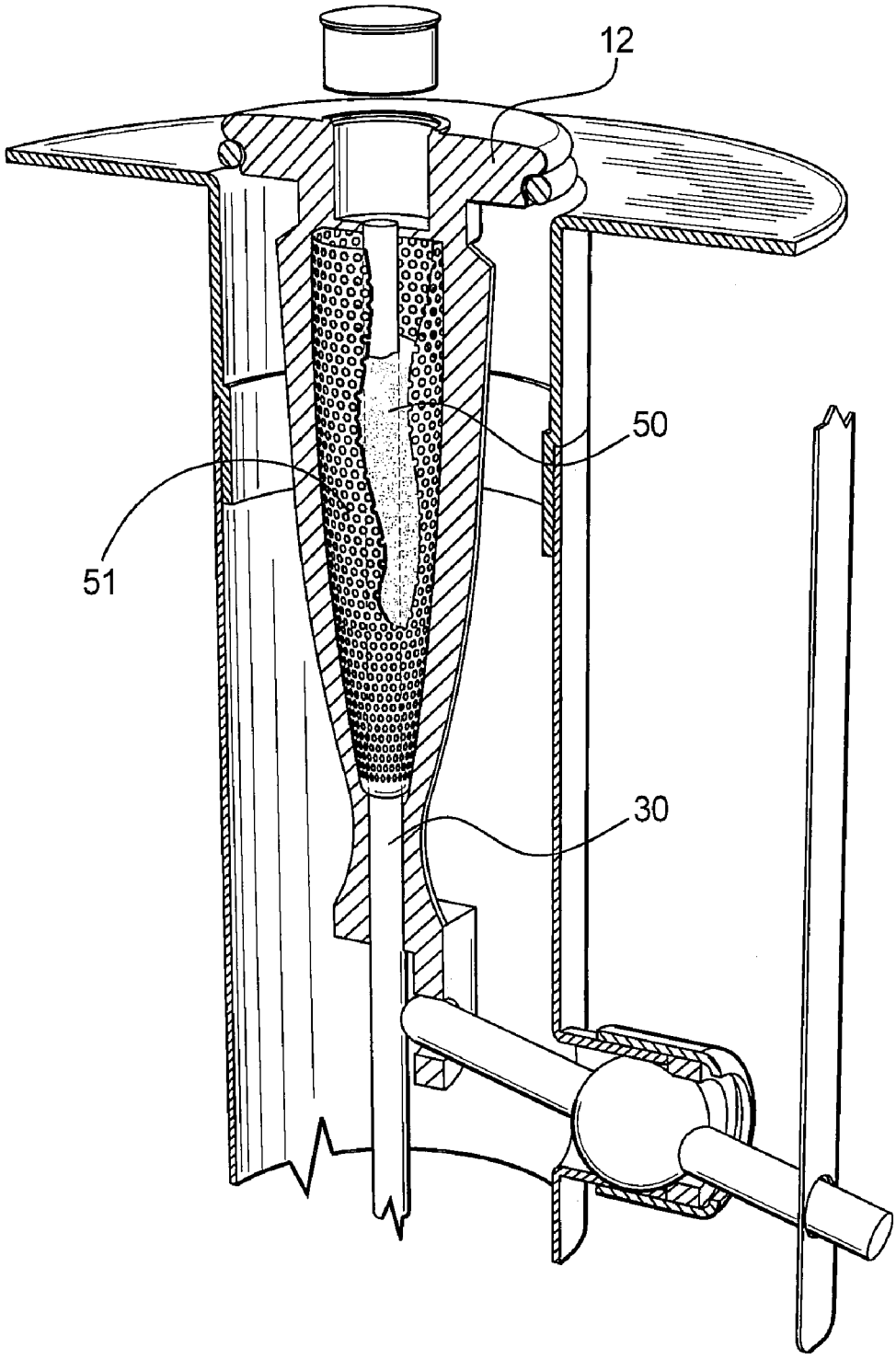
FIG. 3 is a side elevation view, in cross-section, of an alternative embodiment of a drain cleaner constructed according to the present disclosure.

A mass 50 of drain cleaning composition is supported from the stopper head 12. In the illustrated embodiment, the mass 50 is self-supporting, such as a highly viscous gel composition. Alternatively, the mass 50 may be a non-self-supporting material, in which case a liquid permeable retaining structure 51 is coupled to the bottom surface of the stopper head 12 to retain the mass 50, as shown in FIG. 3. If a retaining structure is provided, the mass 50 may be formed of a gel, a solid (such as pellets or granules), a liquid, or a combination thereof. The mass 50 may be formulated to slowly release drain cleaning chemical as it is contacted by fluid, thereby to release drain cleaning chemical during each use of the plumbing fixture associated with the drain pipe 18.

As used herein, the term "drain cleaning composition" encompasses any liquid or solid material, other than water or water from a plumbing supply (e.g. softened water; hard water), which is used or marketed for use to remove drain clogs and/or to, protect against drain clogs. Exemplary drain cleaning compositions include, but are not limited to, caustic materials such as sodium hydroxide, mixtures of sodium hydroxide, metal (e.g. aluminum) chips, and sodium nitrate, or alkaline sodium hypochlorite solutions (e.g. U.S. Pat. No. 4,080,305), as well as other cleaners such as those with additives such as surfactants, proteolytic enzymes, and disulfide reducing agents. See e.g. U.S. Pat. Nos. 4,540,506, 4,619,710 and 3,503,890.

A stopper guide 60 is provided for directing the stopper head 12 to seat with the drain inlet. The stopper guide 60 includes guide vanes 62 having upper ends sized and positioned to closely fit within the drain pipe 18. Lower ends of the guide vanes 62 join at a neck 64. A tail piece 66 depends from the neck 64 and is adapted to engage a pop-up assembly provided with the plumbing fixture. More specifically, the pop-up assembly 61 may include an actuating arm 69 that is manually controlled to move up or down, as indicated by the arrows in FIG. 2. The tail piece 66 includes an orifice 68 sized to receive a tip of the actuating arm 69. Accordingly, movement of the actuating arm 69 will cause a corresponding movement of the stopper guide 60, thereby driving the stopper head 12 toward the open or closed position.

In operation, the drain cleaner 10 provides both a passive discharge of drain cleaning composition from the mass 50 to prevent clogs from forming in a proximal portion of the drain pipe 18, while permitting additional drain cleaning material to be discharged through the tube 30 to a distal portion of the drain pipe 18. The mass 50 effects passive release of drain cleaning composition when liquid passes over the mass 50. Thus, a more continuous, preventative dose of drain cleaning is released into a proximal portion of the drain pipe 18 located adjacent the stopper head 12.

Should a clog form in a more distal part of the drain pipe 18, the cap 26 may be removed and additional drain cleaning composition may be poured into the inlet passage 20. The additional composition passes through the tube 30—via an internal passage and is discharged into a distal portion of the drain pipe 18 therefore, the conduit defines a partition between the conduit internal passage and the drain cleaning composition. In the illustrated embodiment, the tube 30 is sufficiently long so that the tube distal end 34 is positioned downstream of a U-joint 44 formed in the drain pipe 18. Thus, a relatively undiluted dose of chemical composition is discharged into the distal part of the drain pipe 18, which is typically more susceptible to clogging.

Figure 4:
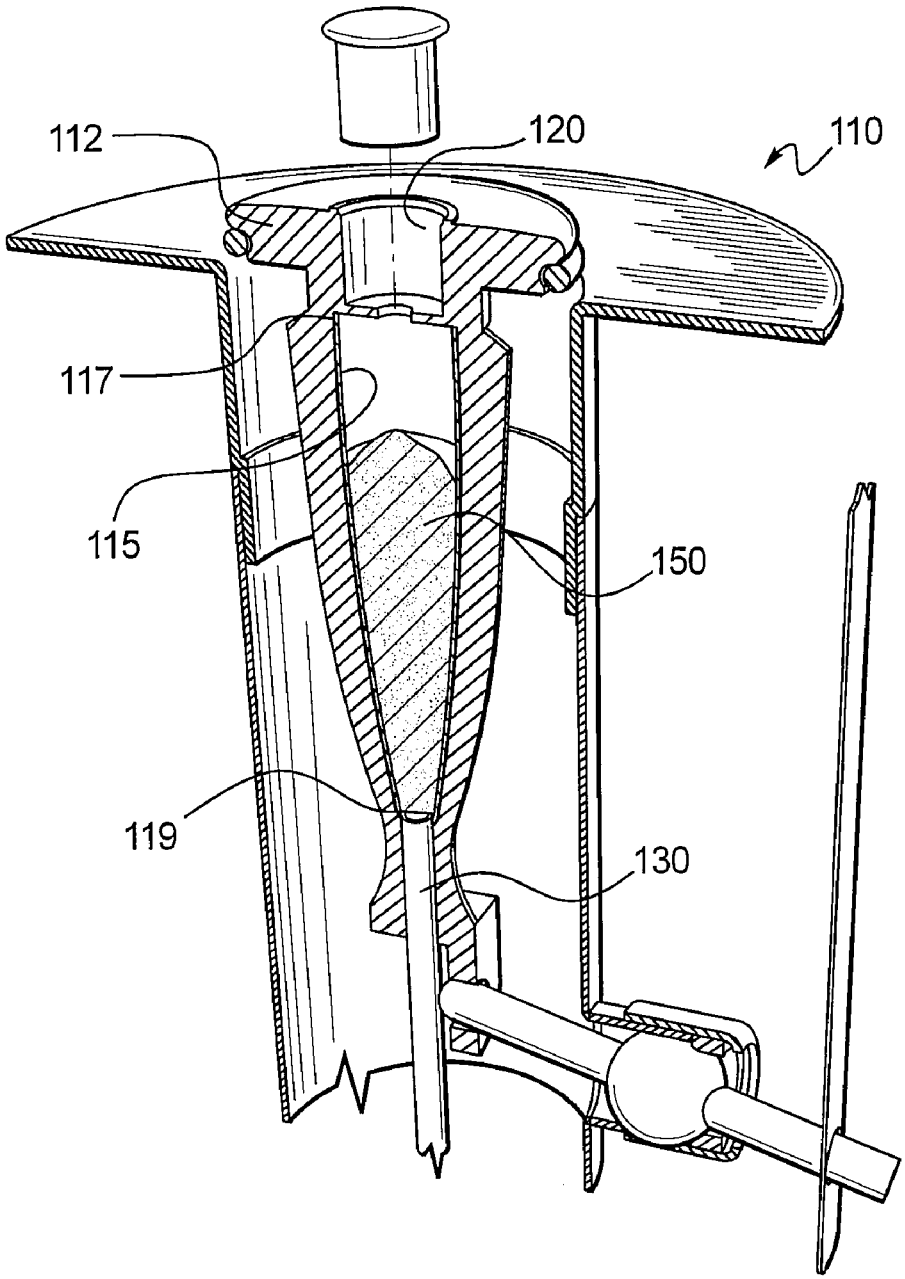
FIG. 4 is a side elevation view, in cross-section, of yet another alternative embodiment of a drain cleaner constructed according to the present disclosure.

An alternative embodiment of a drain cleaner 110 is illustrated in FIG. 4. The drain cleaner 110 is similar to the drain cleaner 10 illustrated in FIGS. 1 and 2, except a chemical mass 150 depending from a stopper head 112 is disposed within a liquid impermeable enclosure 115. The enclosure 115 has a proximal end 117 in fluid communication with an inlet passage 120 extending through the stopper head 112 and a distal end 119 in fluid communication with a tube 130.

In operation, the drain cleaner 110 provides passive discharge of drain cleaning composition from the tube 130. Liquid entering the drain flows through the inlet passage 120 and contacts the mass 150 within the enclosure 115. Drain cleaner is released from the mass 150 and into the liquid, and the solution is subsequently discharged from a distal end of the tube 130. Accordingly, a preventative dose of drain cleaning composition is introduced into a downstream portion of the drain pipe, where clogs are more likely to form. When the tube 130 is sufficiently long, the distal end of the tube 130 may be located within or past a U-joint provided in the drain pipe.

While certain embodiments have been set forth, alternatives and modifications will be apparent from the above description to those skilled in the art. These and other alternatives are considered equivalents and within the spirit and scope of this disclosure and the appended claims.

What is claimed is:

1. A drain cleaner for use with a drain assembly including a drain pipe having a U-joint and a flange coupled to the drain pipe and defining a drain inlet, the drain cleaner comprising:

a stopper head having a seal sized to engage the drain inlet and an inlet passage extending from an inlet port formed in a top surface of the stopper head to an outlet port formed in a bottom surface of the stopper head;

a cap removably coupled to the inlet port;

a conduit coupled to the stopper head with a proximal end in fluid communication with the stopper inlet passage and a distal end, an internal passage extending between the conduit proximal end and conduit distal end, the conduit distal end being sufficiently spaced from the conduit proximal end so that the conduit distal end is disposed in the drain pipe when the stopper head is adjacent the drain inlet, the conduit being formed of a material that is sufficiently flexible to navigate a drain pipe path; and a drain cleaning composition supported below the stopper head bottom surface and positioned such that the conduit defines a partition between the conduit internal passage and the drain cleaning composition.

2. The drain cleaner of claim 1, in which the conduit has a length sufficient so that the conduit distal end is located distally within the drain pipe at least as far as the U-joint.

3. The drain cleaner of claim 1, further comprising a retaining chamber coupled to the stopper head, wherein the drain cleaning composition is disposed within the retaining chamber.

4. The drain cleaner of claim 3, in which the conduit extends through the retaining chamber.

5. The drain cleaner of claim 1, further comprising a stopper guide having a proximal end coupled to the stopper head bottom surface and a distal end.

6. The drain cleaner of claim 5, in which the drain cleaning composition comprises a gel coupled to the stopper guide.

7. The drain cleaner of claim 5, in which the stopper guide includes guide vanes.

8. The drain cleaner of claim 7, in which the drain pipe assembly further includes a pop-up assembly with an actuating arm disposed in the drain pipe, and in which the stopper guide distal end includes a tail piece adapted to operatively engage the actuating arm.

9. The drain cleaner of claim 1, in which the conduit comprises a plastic material.

10. The drain cleaner of claim 1, in which the drain cleaning composition comprises a solid.

11. The drain cleaner of claim 1, in which the drain cleaning composition comprises a gel.

12. A drain cleaner for use with a drain assembly including a drain pipe having a U-joint and a flange coupled to the drain pipe and defining a drain inlet, the drain cleaner comprising:

a stopper head having a seal sized to engage the drain inlet and an inlet passage extending from an inlet port formed in a top surface of the stopper head to an outlet port formed in a bottom surface of the stopper head;

a cap removably coupled to the inlet port;

a conduit coupled to the stopper head bottom surface with a proximal end in fluid communication with the stopper inlet passage and a distal end, an internal passage extending between the conduit proximal end and conduit distal end, the conduit distal end being sufficiently spaced from the conduit proximal end so that the conduit distal end is disposed in the drain pipe when the stopper head is adjacent the drain inlet, the conduit being formed of a material that is sufficiently flexible to navigate a drain pipe path, wherein the conduit has a length sufficient so that the conduit distal end is positioned distally of the U-joint; and a drain cleaning composition supported below the stopper head bottom surface and around an exterior surface of the conduit so that the conduit defines a partition between the conduit internal passage and the drain cleaning composition.

13. The drain cleaner of claim 12, further comprising a stopper guide having a proximal end coupled to the stopper head bottom surface and a distal end.

14. The drain cleaner of claim 13, in which the drain cleaning composition comprises a gel coupled to the stopper guide.

15. The drain cleaner of claim 13, in which the stopper guide includes guide vanes.

16. The drain cleaner of claim 15, in which the drain pipe assembly further includes a pop-up assembly with an actuating arm disposed in the drain pipe, and in which the stopper guide distal end includes a tail piece adapted to operatively engage the actuating arm.

17. A drain cleaner for use with a drain assembly including a drain pipe having a flange coupled to the drain pipe and defining a drain inlet, and a pop-up assembly having an actuating arm disposed in the drain pipe, the drain cleaner comprising:

a stopper head having a seal sized to engage the drain inlet and an inlet passage extending from an inlet port formed in a top surface of the stopper head to an outlet port formed in a bottom surface of the stopper head;

a cap removably coupled to the stopper head inlet port;

a conduit coupled to the stopper head with a proximal end in fluid communication with the stopper inlet passage and a distal end, an internal passage extending between the conduit proximal end and conduit distal end, the conduit distal end being sufficiently spaced from the conduit proximal end so that the conduit distal end is disposed in the drain pipe when the stopper head is adjacent the drain inlet, the conduit being formed of a material that is sufficiently flexible to navigate a drain pipe path; and a stopper guide having a proximal end coupled to the stopper head bottom surface and a distal end, the stopper guide distal end including a tail piece adapted to operatively engage the actuating arm of the pop-up assembly; and a drain cleaning composition supported below the stopper head bottom surface and positioned such that the conduit defines a partition between the conduit internal passage and the drain cleaning composition.

18. The drain cleaner of claim 17, in which the drain pipe includes a U-joint, and in which the conduit has a length sufficient so that the conduit distal end is located distally within the drain pipe at least as far as the U-joint.

19. The drain cleaner of claim 17, in which the drain cleaning composition comprises a gel.

* * * * *